US010711632B2

(12) United States Patent
Snider et al.

(10) Patent No.: US 10,711,632 B2
(45) Date of Patent: Jul. 14, 2020

(54) VARIABLE NOZZLES IN TURBINE ENGINES AND METHODS RELATED THERETO

(71) Applicant: General Electric Company, Schenectady, NY (US)

(72) Inventors: Zachary John Snider, Simpsonville, SC (US); Gary Charles Liotta, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 34 days.

(21) Appl. No.: 16/116,153

(22) Filed: Aug. 29, 2018

(65) Prior Publication Data

US 2020/0072073 A1 Mar. 5, 2020

(51) Int. Cl.
*F01D 17/16* (2006.01)
*F01D 9/04* (2006.01)

(52) U.S. Cl.
CPC ..... *F01D 17/162* (2013.01); *F01D 9/041* (2013.01); *F05D 2220/32* (2013.01); *F05D 2240/128* (2013.01); *F05D 2240/50* (2013.01)

(58) Field of Classification Search
None
See application file for complete search history.

(56) References Cited

U.S. PATENT DOCUMENTS 3,558,237 A * 1/1971 Wall, Jr. ..... F01D 17/162 415/115
3,567,331 A * 3/1971 Corrigan et al. ..... F01D 17/14 415/126
3,999,883 A * 12/1976 Nordenson ..... F01D 17/162 415/113
4,025,227 A * 5/1977 Greenberg ..... F01D 17/162 415/160
8,668,445 B2 * 3/2014 Crespo ..... F01D 9/04 415/160
9,033,654 B2 5/2015 Peck et al.
9,080,448 B2 7/2015 King
9,273,565 B2 3/2016 Propheter-Hinckley
9,309,778 B2 4/2016 Ress, Jr.
(Continued)

FOREIGN PATENT DOCUMENTS

EP 2055903 A2 5/2009

*Primary Examiner* — Michael Lebentritt
(74) *Attorney, Agent, or Firm* — Charlotte C. Wilson; James W. Pemrick

(57) ABSTRACT

A turbine engine having a variable nozzle assembly that includes: a variable nozzle having an airfoil that extends radially across an annulus formed between inner and outer platforms; and a segmented shaft that translates a torque between segments included therewithin. The segmented shaft may include a first and second segment. The first segment of the segmented shaft may include: the airfoil of the variable nozzle; an outer stem extending from the outer end of the airfoil; and an inner stem extending from the inner end of the airfoil. A first and second connector may connect the first segment to the inner platform and outer platform, respectively. A third connector may connect the first segment to the second segment. The first and second connector may include a first and second spherical bearing, respectively. The third connector may include a first universal joint.

20 Claims, 14 Drawing Sheets

(56) References Cited

U.S. PATENT DOCUMENTS

| | | | | |
|---|---|---|---|---|
| 2012/0093632 | A1* | 4/2012 | Crespo | F01D 9/04 415/151 |
| 2013/0216361 | A1 | 8/2013 | Propheter-Hinckley | |
| 2014/0154046 | A1* | 6/2014 | Hensley | F01D 17/162 415/1 |
| 2014/0237987 | A1 | 8/2014 | Bloxham et al. | |

* cited by examiner

VARIABLE NOZZLES IN TURBINE ENGINES AND METHODS RELATED THERETO

BACKGROUND OF THE INVENTION

The subject matter disclosed herein relates to turbine engines having variable geometry flow components, and more particularly, but not exclusively, to turbine engines having variable stator blades or nozzles.

To improve performance, turbine engines may include one or more rows of variable stator blades or nozzles ("variable nozzles") configured to be rotated about their longitudinal axes in order to vary flowpath geometry. Such variable nozzles generally permit enhanced efficiency over a wider operability range by controlling the flow of working fluid through the working fluid flowpath via rotating the angle at which the nozzle airfoils are oriented relative to the flow of working fluid. Rotation of the variable nozzles is generally accomplished by attaching a driver arm to each nozzle and then joining the levers to a synchronizing ring disposed substantially concentric with respect to the turbine casing. As the synchronizing ring is rotated by an actuator, the lever arms are correspondingly rotated, thereby causing each of the nozzles to rotate about its longitudinal axis.

Providing variable geometry capabilities to nozzles of turbine engines remains an area of interest because of the improved output and efficiency over a range of part load and ambient conditions. However, existing systems have various shortcomings, including, for example, durability, leakage, constructability, and installation issues related to the assemblies used to translate the necessary torque from the driver arm to the nozzle airfoils. Accordingly, there remains a need for further advances in this area of technology.

BRIEF DESCRIPTION OF THE INVENTION

The present application thus describes a turbine engine having a variable nozzle assembly that includes: a variable nozzle having an airfoil that extends radially across an annulus formed between inner and outer platforms; and a segmented shaft that translates a torque between segments included therewithin. The segmented shaft may include a first and second segment. The first segment of the segmented shaft may include: the airfoil of the variable nozzle; an outer stem extending from the outer end of the airfoil; and an inner stem extending from the inner end of the airfoil. First and second connectors may connect the first segment to the inner platform and outer platform, respectively. A third connector may connect the first segment to the second segment. The first and second connector may include first and second spherical bearings, respectively. The third connector may include a first universal joint.

BRIEF DESCRIPTION OF THE DRAWINGS

These and other features of this invention will be more completely understood and appreciated by careful study of the following more detailed description of exemplary embodiments of the invention taken in conjunction with the accompanying drawings, in which.

DETAILED DESCRIPTION OF THE INVENTION

Figure 1:
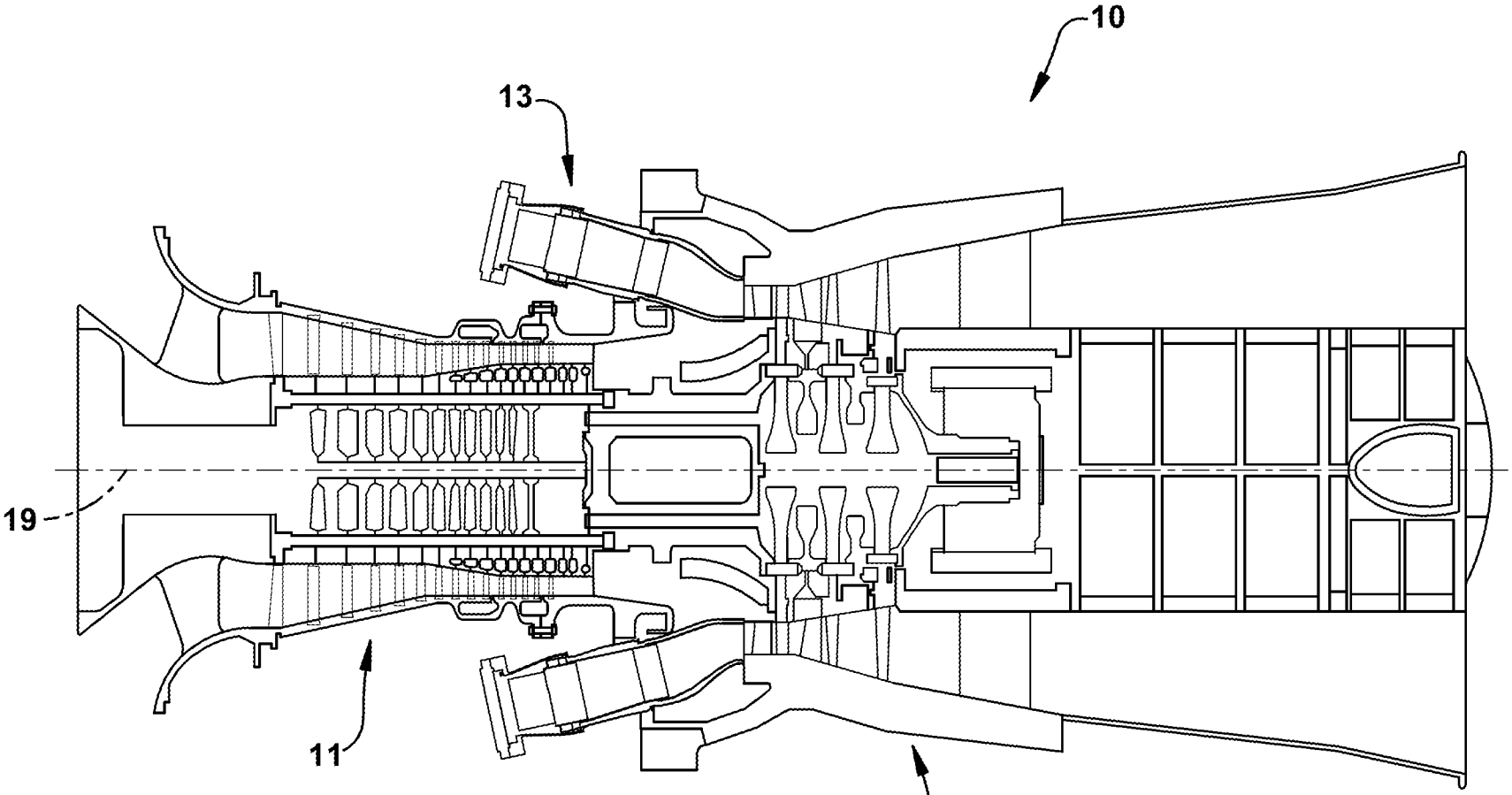
FIG. 1 is a schematic sectional representation of an exemplary gas turbine engine in accordance with aspects of the present invention or within which the present invention may be used.

Aspects and advantages of the present application are set forth below in the following description, or may be obvious from the description, or may be learned through practice of the invention. Reference will now be made in detail to present embodiments of the invention, one or more examples of which are illustrated in the accompanying drawings. The detailed description uses numerical designations to refer to features in the drawings. Like or similar designations in the drawings and description may be used to refer to like or similar parts of embodiments of the invention. As will be appreciated, each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. It is intended that the present invention covers such modifications and variations as come within the scope of the appended claims and their equivalents. It is to be understood that the ranges and limits mentioned herein include all sub-ranges located within the prescribed limits, inclusive of the limits themselves unless otherwise stated. Additionally, certain terms have been selected to describe the present invention and its component subsystems and parts. To the extent possible, these terms have been chosen based on terminology common to the technology field. Still, it will be appreciated that such terms often are subject to differing interpretations. For example, what may be referred to herein as a single component, may be referenced elsewhere as consisting of multiple components, or, what may be referenced herein as including multiple components, may be referred to elsewhere as being a single component. Thus, in understanding the scope of the present invention, attention should not only be paid to the particular terminology used, but also to the accompanying description and context, as well as the structure, configuration, function, and/or usage of the component being referenced, including the manner in which the term relates to the several figures, as well as, of course, the usage of the terminology in the appended claims.

The following examples are presented in relation to particular types of turbine engines. However, it should be understood that the technology of the present application may be applicable to other categories of turbine engines, without limitation, as would be appreciated by a person of ordinary skill in the relevant technological arts. Accordingly, unless otherwise stated, the usage herein of the term "turbine engine" is intended broadly and without limiting the usage of the claimed invention with different types of turbine engines, including various types of combustion or gas turbine engines and steam turbine engines.

Given the nature of how turbine engines operate, several terms may prove particularly useful in describing certain aspects of their function. For example, the terms "downstream" and "upstream" are used herein to indicate position within a specified conduit or flowpath relative to the direction of flow or "flow direction" of a fluid moving through it. Thus, the term "downstream" refers to the direction in which a fluid is flowing through the specified conduit, while "upstream" refers to the direction opposite that. These terms should be construed as referring to the flow direction through the conduit given normal or anticipated operation.

Additionally, given the configuration of turbine engines, particularly the arrangement of the components about a common or central shaft, terms describing position relative to an axis may be used regularly. In this regard, it will be appreciated that the term "radial" refers to movement or position perpendicular to an axis. Related to this, it may be required to describe relative distance from the central axis. In such cases, for example, if a first component resides closer to the central axis than a second component, the first component will be described as being either "radially inward", "inner" or "inboard" of the second component. If, on the other hand, the first component resides further from the central axis than the second, the first component will be described as being either "radially outward", "outer" or "outboard" of the second component. As used herein, the term "axial" refers to movement or position parallel to an axis, while the term "circumferential" refers to movement or position around an axis. Unless otherwise stated or made plainly apparent by context, these terms should be construed as relating to the central axis of the turbine as defined by the shaft extending therethrough, even when these terms are describing or claiming attributes of non-integral components—such as rotor blades or nozzles—that function therein. Finally, the term "rotor blade" is a reference to the blades that rotate about the central axis of the turbine engine during operation, while the terms "stator blades" or "nozzles" refer to the blades that remain stationary.

Figure 2:
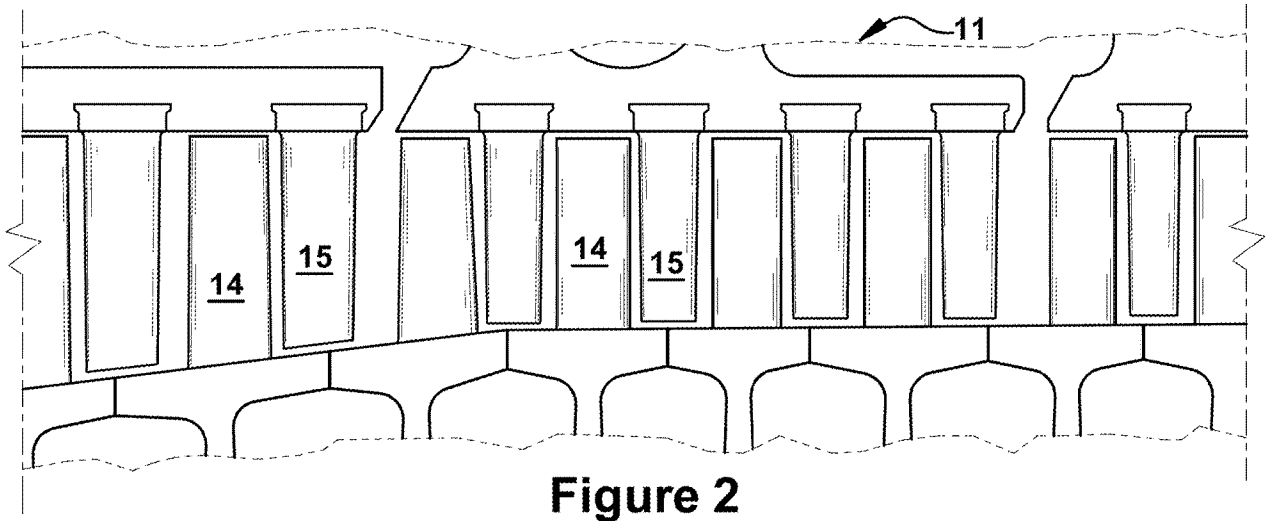
FIG. 2 is a section view of the compressor section of the gas turbine engine of FIG. 1.
Figure 3:
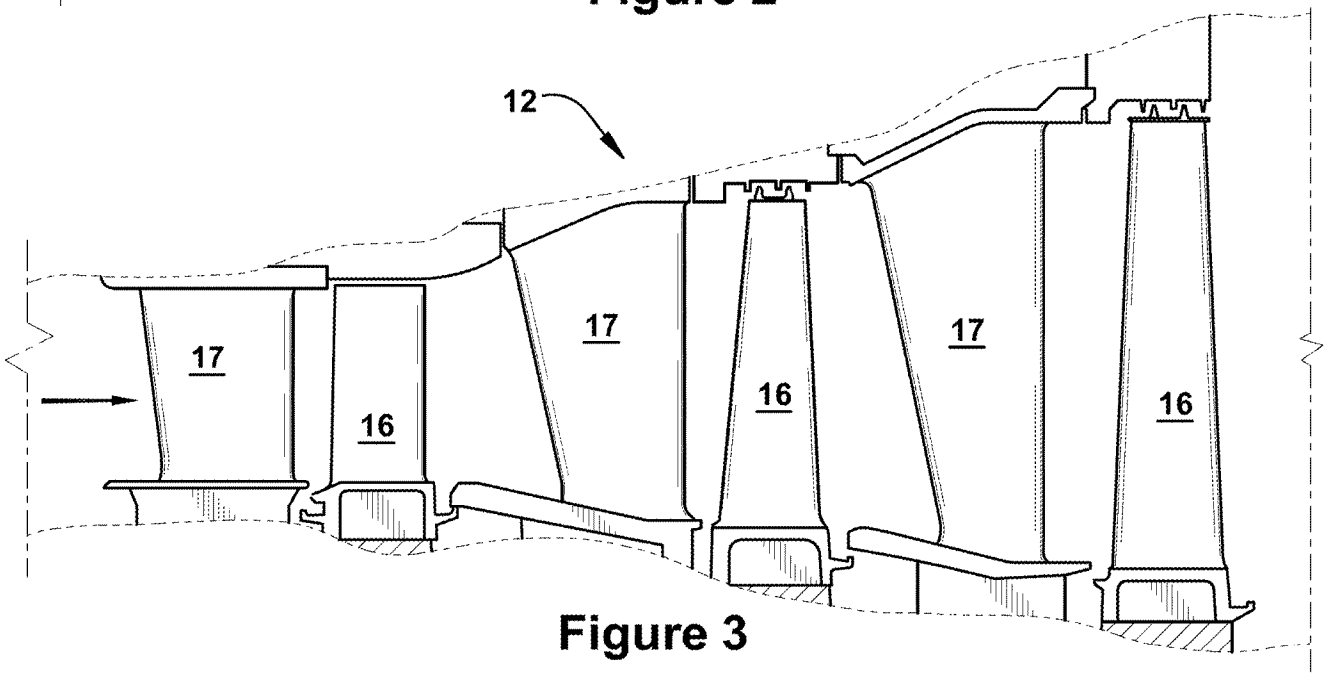
FIG. 3 is a section view of the turbine section of the gas turbine engine of FIG. 1.

By way of background, with reference now to the figures, FIGS. 1 through 3 illustrate an exemplary gas turbine engine in accordance with the present invention or within which the aspects of the present invention may be used. The present invention may not be limited to this type of usage. The present invention may be used in gas turbines, such as the engines used in power generation and airplanes, and/or steam turbine engines, as well as other types of rotary engines, as would be recognized by one of ordinary skill in the art. FIG. 1 is a schematic representation of a gas turbine engine 10. In general, gas turbine engines operate by extracting energy from a pressurized flow of hot gas produced by the combustion of a fuel in a stream of compressed air. As illustrated in FIG. 1, gas turbine engine 10 may be configured with an axial compressor 11 that is mechanically coupled by a common shaft or rotor to a downstream turbine section or turbine 12, and a combustor 13 positioned between the compressor 11 and the turbine 12. As illustrated in FIG. 1, the gas turbine engine may be formed about a common central axis 19.

FIG. 2 illustrates a view of an exemplary multi-staged axial compressor 11 that may be used in the gas turbine engine of FIG. 1. As shown, the compressor 11 may have a plurality of stages, each of which include a row of compressor rotor blades 14 and a row of compressor stator blades or nozzles 15. Thus, a first stage may include a row of compressor rotor blades 14, which rotate about a central shaft, followed by a row of compressor nozzles 15, which remain stationary during operation. FIG. 3 illustrates a partial view of an exemplary turbine section or turbine 12 that may be used in the gas turbine engine of FIG. 1. The turbine 12 also may include a plurality of stages. Three exemplary stages are illustrated, but more or less may be present. Each stage may include a plurality of turbine stator blades or nozzles 17, which remain stationary during operation, followed by a plurality of turbine buckets or rotor blades 16, which rotate about the shaft during operation. The turbine nozzles 17 generally are circumferentially spaced one from the other and fixed about the axis of rotation to an outer casing. The turbine rotor blades 16 may be mounted on a turbine wheel or rotor disc (not shown) for rotation about a central axis. It will be appreciated that the turbine nozzles 17 and turbine rotor blades 16 lie in the hot gas path or working fluid flowpath through the turbine 12. The direction of flow of the combustion gases or working fluid within the working fluid flowpath is indicated by the arrow.

In one example of operation for the gas turbine engine 10, the rotation of compressor rotor blades 14 within the axial compressor 11 may compress a flow of air. In the combustor 13, energy may be released when the compressed air is mixed with a fuel and ignited. The resulting flow of hot gases or working fluid from the combustor 13 is then directed over the turbine rotor blades 16, which induces the rotation of the turbine rotor blades 16 about the shaft. In this way, the energy of the flow of working fluid is transformed into the mechanical energy of the rotating blades and, given the connection between the rotor blades and the shaft, the rotating shaft. The mechanical energy of the shaft may then be used to drive the rotation of the compressor rotor blades 14, such that the necessary supply of compressed air is produced, and also, for example, a generator to produce electricity.

Figure 4:
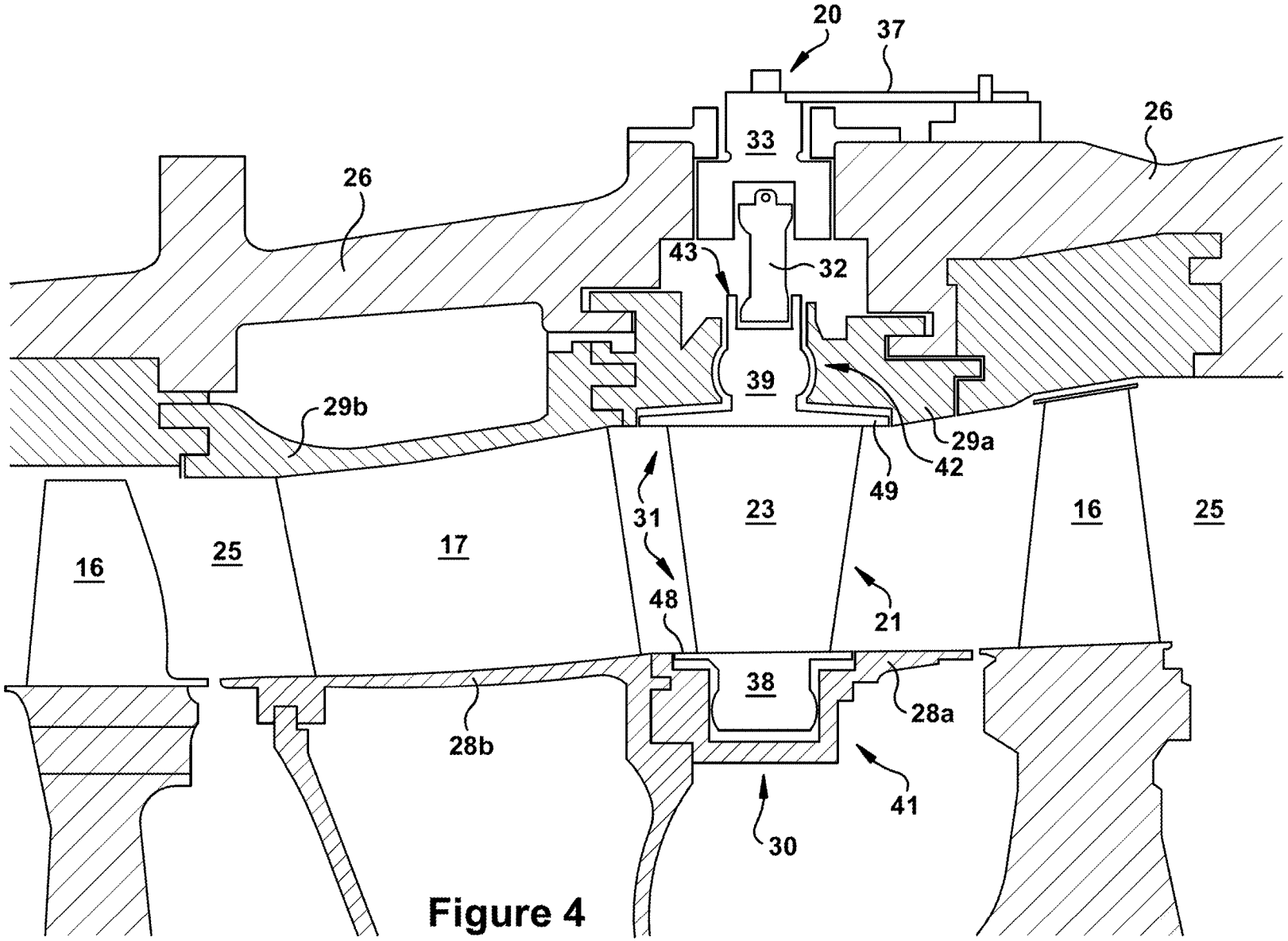
FIG. 4 is a section view of a working fluid flowpath that includes an exemplary variable nozzle assembly in accordance with the present application.

FIG. 4 illustrates an exemplary variable nozzle assembly 20 that can be incorporated into a turbine engine, such as, for example, a gas turbine engine 10. In this example, the variable nozzle assembly 20 is a turbine nozzle assembly. However, the variable nozzle assembly 20 could be incorporated into a compressor. As will be appreciated, while the description will focus on describing a single variable nozzle assembly 20, a plurality of such variable nozzle assemblies would normally be mechanically attached to one another and annularly disposed about the central axis 19 to form a full nozzle row. The variable nozzle assembly 20 generally includes a variable nozzle 21 that rotates an airfoil 23 between two or more operating positions to alter a flow area through a working fluid flowpath defined through the engine. In this way, flowpath characteristics may be controllably modified, which, as stated above, may be used to improve output and efficiency over a greater range of part load and ambient conditions. As will be discussed more below, the variable nozzle assembly 20 can include the coupling of variable nozzles 21 with fixed nozzles 17. Thus, as illustrated, the row of fixed nozzles 17 may lead or be upstream of the row of variable nozzles 21. As further shown, a row of rotor blades 16 may be positioned to each side of the coupled rows of fixed and variable nozzles 17, 20.

In general, according to disclosure of the present application, the variable nozzle assembly 20 may include a variable nozzle 21 in which an airfoil 23 extends radially across working fluid flowpath or annulus 25. The annulus 25 is generally defined by structure that will be referred to herein as "platforms". Thus, as used herein, the annulus 25 is defined between a downstream pair of inner and outer platforms (or "downstream inner platform 28*a*" and "downstream outer platform 29*a*") and an upstream pair of upstream inner and outer platforms (or "upstream inner platform 28*b*" and "upstream outer platform 29*b*") that correspond to the variable nozzle 21 and the fixed nozzle 17, respectively. The depicted inner platforms 28, which define the inner boundary of the annulus 25, may be referred to as a downstream inner platform 28*a*, which corresponds to the variable nozzle 21, and an upstream inner platform 28*b*, which corresponds to the fixed nozzle 17. Likewise, the depicted outer platforms 29, which defined the outer boundary of the annulus 25, may be referred to as a downstream outer platform 29*a*, which corresponds to the variable nozzle 21, and an upstream outer platform 29*b*, which corresponds to the fixed nozzle 17. The upstream inner platform 28*b* may be connected to the downstream inner platform 28*a* via a rigid connection formed along abutting sidewalls, such as by a mechanical fastener, e.g., bolts. Finally, the outer platforms 29*a*, 29*b* may be supported by a structural casing ("casing 26") that is formed about and encloses the turbine. For example, as shown, the outer platforms 29*a*, 29*b* may be supported by the casing 26 via a circumferentially engaged connector in which mating surfaces on the outer platforms 29*a*, 29*b* interlock with corresponding mating surfaces formed in the casing 26.

As will be seen, the airfoil 23 of the variable nozzle 21 may rotate relative to the inner and outer platforms 28*a*, 29*a*, where that rotation is about a longitudinal axis of the airfoil 23, which, in general, is a radially oriented axis, e.g., perpendicular to the engine centerline defined by the central shaft 19. The airfoil 23 of the variable nozzle 21 may be described as having inner and outer ends, which are defined relative to the inner and outer platforms 28*a*, 29*a*, respectively.

According to the disclosure of the present application, the variable nozzle assembly 20 includes a segmented shaft 30, which, as will be seen, is configured to translate a torque between the segments contained within it. As will be appreciated, this torque is translated between an input device, such as the illustrated lever or driver arm 37, and the airfoil 23 of the variable nozzle 21 so to rotate the airfoil 23 about its longitudinal axis. In this way, the angular position of the airfoil 23 relative to the flow direction of the working fluid is desirably varied to suit operating conditions. As described in more detail below, the segmented shaft 30 may include several segments, including, for example, a first segment 31, a second segment 32, and a third segment 33.

According to the disclosure of the present application, the first segment 31 of the segmented shaft 30 includes the airfoil 23 of the variable nozzle 21 and stems formed at opposing longitudinal ends of the airfoil 23. Specifically, an inner stem 38 may extend from the inner end of the airfoil 23, and an outer stem 39 may extend from the outer end of the airfoil 23. The inner and outer stems 38, 39 may be integrally formed with the airfoil 23 of the variable nozzle 21. Relative to the central body of the airfoil 23, the inner and outer stems 38, 39 may be described herein as having distal and proximal ends.

According to the disclosure of the present application, the second segment 32 of the segmented shaft 30 may include a rigid shaft or rod, which extends in the outboard direction from a connection it forms with an end of the first segment 31. The second segment 32 may extend between inner and outer ends, which may also be referred to as first and second longitudinal ends, respectively. As illustrated, the first longitudinal end of the second segment 32 may connect to the distal end of the outer stem 39 of the first segment 31.

According to the disclosure of the present application, the third segment 33 of the segmented shaft 30 continues in the outboard direction from a connection formed with the second segment 32. As with the second segment 32, the third segment 33 may be described as extending between inner and outer ends, which also may be referred to as first and second longitudinal ends, respectively. As illustrated, the first longitudinal end of the third segment 33 may connect to the second longitudinal end of the second segment 32. As further illustrated, between its first and second longitudinal ends, the third segment 33 may extend through an opening formed through the casing 26 (referenced below as "casing opening 95") of the turbine. Additionally, the second longitudinal end of the third segment 33 may include a connection with the driver arm 37 that delivers the torque translated through the segmented shaft 30 for rotating the airfoil 23 of the variable nozzle 21.

As will now be described with reference also to FIGS. 5 through 7, the variable nozzle assembly 20 may have a plurality of connectors, which include one or more types of joints and bearings, that connect the segments of the segmented shaft 30 to each other as well as connect the segmented shaft 30 to the surrounding structure, such as, inner and outer platforms 28*a*, 29*a* and casing 26. Together with the segmented shaft 30, these connectors have been found to improve certain functionality and performance criteria related to variable nozzle assemblies in several ways, including, for example, durability of the assembly, constructability, installation, serviceability, reduced variability in output, and avoidance of rotational binding under heavy loading. As provided in more detail below, such connectors may include: a first connector 41; a second connector 42; a third connector 43; a fourth connector 44; and a fifth connector 45. As illustrated, the first connector 41 and second connector 42 connect the first segment 31 to the inner platform 28 and outer platform 29, respectively, while the third connector 43 connects the first segment 31 to the second segment 32. Continuing along the segmented shaft 30 in outboard direction, the fourth connector 44 connects the second segment 32 to the third segment 33, and, finally, the fifth connector 45 connects the third segment 33 to the casing 26.

According to the disclosure of the present application, the first connector 41 may connect the first segment 31 to the inner platform 28. According to exemplary embodiments, the first connector 41 may include a spherical bearing, as shown in more detail in FIG. 5. The first connector 41 may be further configured such that, upon engagement, the first connector 41: allows radial movement of the first segment 31 relative to the inner platform 28; and allows rotational movement of the first segment 31 relative to the inner platform 28.

More particularly, as illustrated, the spherical bearing of the first connector 41 may include a spherical shaped section 51 received within a correspondingly sized cylindrical opening 52. The spherical shaped section 51 of the first connector 41 may be formed on a distal end of the inner stem 38, while the cylindrical opening 52 of the first connector 41 may be formed within the inner platform 28. As will be appreciated, because of the shape of the spherical shaped section 51 within the cylindrical opening 52, certain types and ranges of relative movement between the two components may be allowed, which can be used to accommodate relative movement caused by thermal or mechanical operational loads. For example, the spherical shaped section 51 can be moved in radially outward or inward directions or be tilted relative to the cylindrical opening 52. It has been found that the described configuration and functionality of the first connector 41, when coupled with one or more of the other connectors disclosed herein, allows the present variable nozzle 21 to avoid binding when placed under operational loads so that the continued rotation of the airfoil 23 is possible. As further shown, a proximal end of the inner stem 38 may include a plate 48 that rotatably engages a correspondingly shaped recess 53 formed on the inner platform 28.

According to the disclosure of the present application, the second connector 42 may connect the first segment 31 to the outer platform 29. According to exemplary embodiments, the second connector 42 may include a spherical bearing, as shown in more detail in FIG. 6. The second connector 42 may be configured such that, upon engagement, the second connector 42: prevents radial movement of the first segment 31 relative to the outer platform 29; and allows rotational movement of the first segment 31 relative to the outer platform 29.

More particularly, as illustrated, the second connector 42 may include a spherical shaped section 55 surrounded by a correspondingly shaped spherical opening 56. The spherical shaped section 55 of the second connector 42 may be formed on the outer stem 39, while the spherical opening 56 of the second connector 42 may be formed within the outer platform 29. As will be discussed in more detail below, the spherical opening 56 may be formed by a sectioned cup-ring 81 and lock-nut 85 arrangement that facilitates assembly. As will be appreciated, because of the shape of the spherical shaped section 55 within the spherical shaped opening 56, certain types and ranges of relative movement between the two components may be allowed, which can be used to accommodate relative movement caused by operational loads. For example, while spherical shaped section 55 is restricted radially, it can be tilted relative to the spherical shaped opening 56. It has been found that the described configuration and functionality of the second connector 42, when coupled with one or more of the other connectors disclosed herein, allows the present variable nozzle 21 to avoid binding when placed under operational loads so that the continued rotation of the airfoil 23 is possible. As further shown, a proximal end of the outer stem 39 may include a plate 49 that rotatably engages a correspondingly shaped recess 57 formed on the outer platform 29.

As an alternative embodiment, the connection types of the first connector 41 and the second connector 42 are essentially reversed so that: a) the type of connection described above for the second connector 42—in which a spherical shaped section is surrounded by a correspondingly shaped spherical opening 56 that restricts relative radial movement—is used to connect the inner stem 38 of the first segment 31 to the inner platform 28; and b) the type of connection described above for the first connector 42—in which a spherical shaped section is received within a correspondingly sized cylindrical opening that allows relative radial movement—is used to connect the first segment 31 to the outer platform 29. Thus, an exemplary embodiment includes one of the spherical bearings of the first and second connectors 41, 42 being radially restricted, while the other of the spherical bearings of the first and second connectors 41, 42 allowing relative radial movement.

According to the disclosure of the present application, the third connector 43 may connect the first segment 31 to the second segment 32. According to exemplary embodiments, the third connector 43 may be configured as a universal joint, as shown in more detail in FIG. 7. The universal joint of the third connector 43 may be configured to allow relative movement changing the angle formed between the longitudinal axes of the first and second segments 31, 32 while still translating the necessary torque between the first and second segments 31, 32. The third connector 43 may be configured such that, upon engagement, the third connector 43: allows radial movement of the first segment 31 relative to the second segment 32; and prevents rotational movement of the first segment 31 relative to the second segment 32.

More particularly, as illustrated, the third connector 43 may include an opening 61 that receives a correspondingly shaped insertable portion 62. The opening 61 of the third connector 43 may be formed in a distal end of the outer stem 39, while the insertable portion 62 may be formed on the inner or first longitudinal end of the second segment 32. As will be appreciated, given the shape of the insertable portion 62 and the opening 61, certain types and ranges of relative movement between the two components may be allowed, which can be used to accommodate relative movement caused by operational loads. For example, because of the curved surface of the insertable portion 62 contacting the flat surface defined within the opening 61, the insertable portion 62 can be tilted relative to the opening 61. Further, the insertable portion 62 is not restricted radially within the opening 61. It has been found that the described configuration and functionality of the third connector 43, when coupled with one or more of the other connectors disclosed herein, allows the present variable nozzle 21 to avoid binding when placed under operational loads so that the continued rotation of the airfoil 23 is possible.

According to the disclosure of the present application, the fourth connector 44 may connect the outer or second longitudinal end of the second segment 32 to the inner or first longitudinal end of the third segment 33. According to exemplary embodiments, the fourth connector 44 may be configured as a universal joint, as shown in more detail in FIG. 7. The universal joint of the fourth connector 44 may be configured to allow relative movement changing an angle formed between longitudinal axes of the second and third segments 32, 33 while still translating the torque between the second and third segments 32, 33. In this case, the universal joint may include a pin 63 or other component for restricting relative radial movement. Thus, the fourth connector 44 may be configured such that, upon engagement, the fourth connector 44: prevents radial movement of the second segment 32 relative to the third segment 33; and prevents rotational movement of the second segment 32 relative to the third segment 33.

More particularly, as illustrated, the fourth connector 44 may include an opening 64 that receives a correspondingly shaped insertable portion 65. The opening 64 of the fourth connector 44 may be formed in the inner or first longitudinal end of the third segment 33, while the insertable portion 65 may be formed on the outer or second longitudinal end of the second segment 32. As will be appreciated, given the shape of the insertable portion 65 and the opening 64, certain types and ranges of relative movement between the two components may be allowed, which can be used to accommodate relative movement caused by operational loads. For example, because of the curved surface of the insertable portion 65 contacting the flat surface defined within the opening 64, the insertable portion 65 can be tilted relative to the opening 64. It has been found that the described configuration and functionality of the fourth connector 44, when coupled with one or more of the other connectors disclosed herein, allows the present variable nozzle 21 to avoid binding when placed under operational loads so that the continued rotation of the airfoil 23 is possible.

According to the disclosure of the present application, the fifth connector 45 may connect the third segment 33 to the casing 26 of the turbine. More specifically, as shown in more detail in FIG. 7, the fifth connector 45 may be configured as a cylindrical bearing that allows rotational movement of the third segment 33 relative to the casing 26 of the turbine. For example, the inner cylinder of the third segment 33 may be configured to rotate within a stationary cylinder secured to the casing 26. It has been found that the described configuration and functionality of the fifth connector 45, when coupled with one or more of the other connectors disclosed herein, allows the present variable nozzle 21 to avoid binding when placed under operational loads so that the continued rotation of the airfoil 23 is possible.

Figure 5:
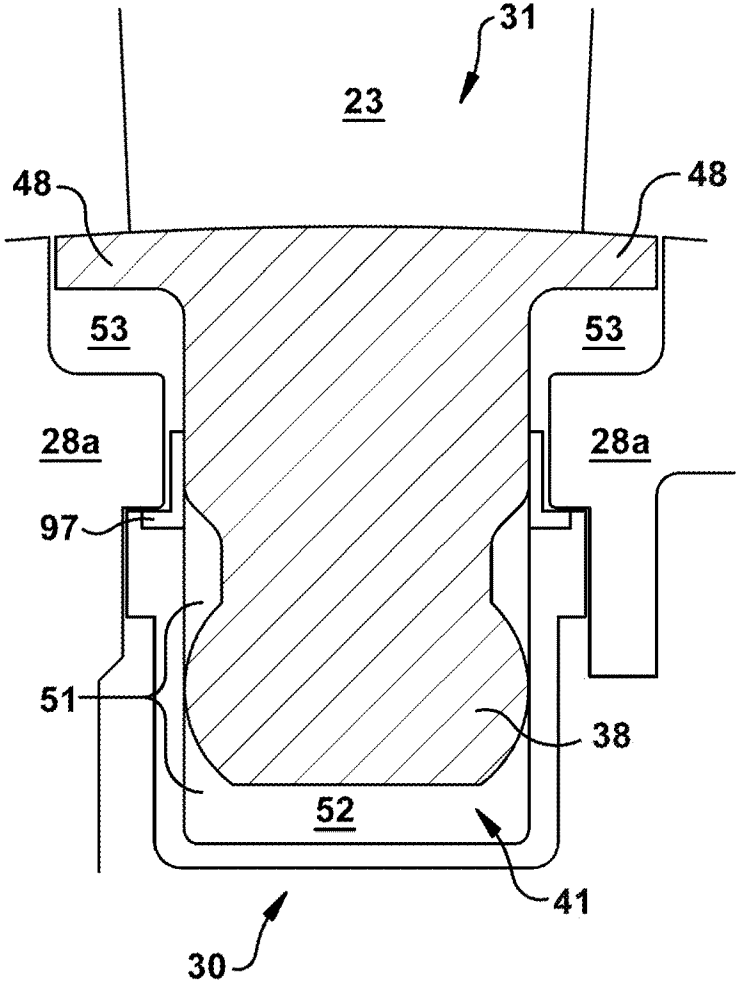
FIG. 5 is a section view of an exemplary connector and other components as may be used with the variable nozzle assembly of FIG. 4.
Figure 6:
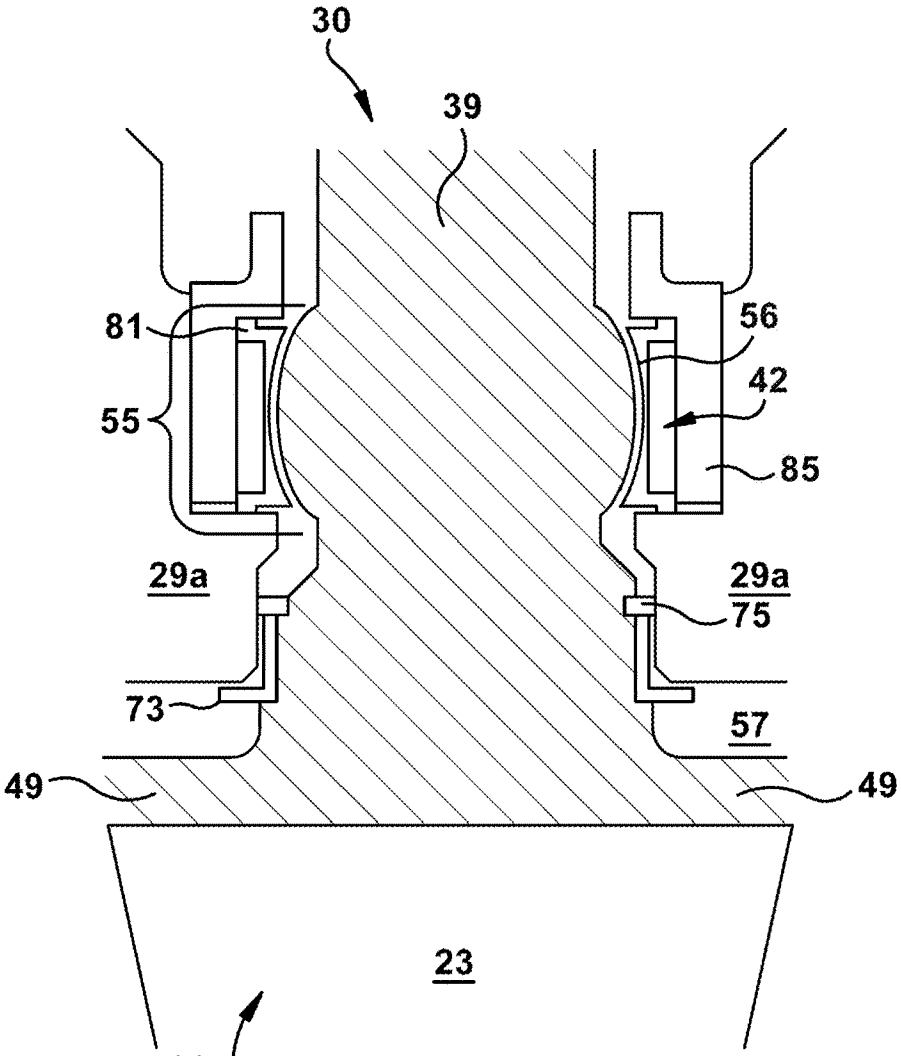
FIG. 6 is a section view of an exemplary connector and other components as may be used with the variable nozzle assembly of FIG. 4.
Figure 7:
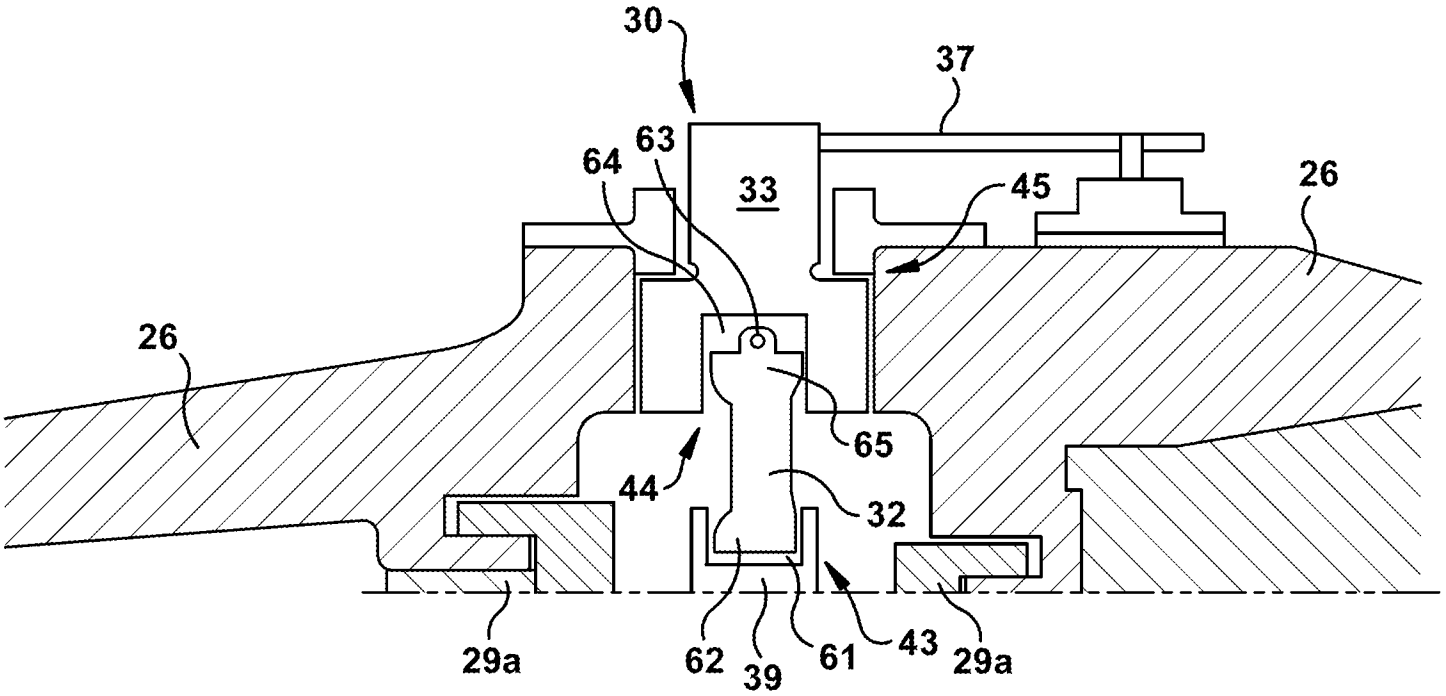
FIG. 7 is a section view of an exemplary connector and other components as may be used with the variable nozzle assembly of FIG. 4.

As also depicted within FIGS. 5 through 7, the variable nozzle assembly 20 may include one or more seals for preventing or reducing the leakage of working fluid. As illustrated, these, for example, may include dish seal 73, ring seal 75, and diaphragm seal 97. As will be appreciated, leak mitigation is a significant consideration in the design of variable nozzles. Because variable nozzles require various bearings and openings (e.g., through the platforms and casing) to function, successful designs are generally those that facilitate effective sealing, which may include aspects related to seal construction, installation, and maintenance. As will be discussed in more detail below in connection with methods of assembling variable nozzles, the present application discloses one or more seals and related componentry that further these performance objectives.

Figure 8:
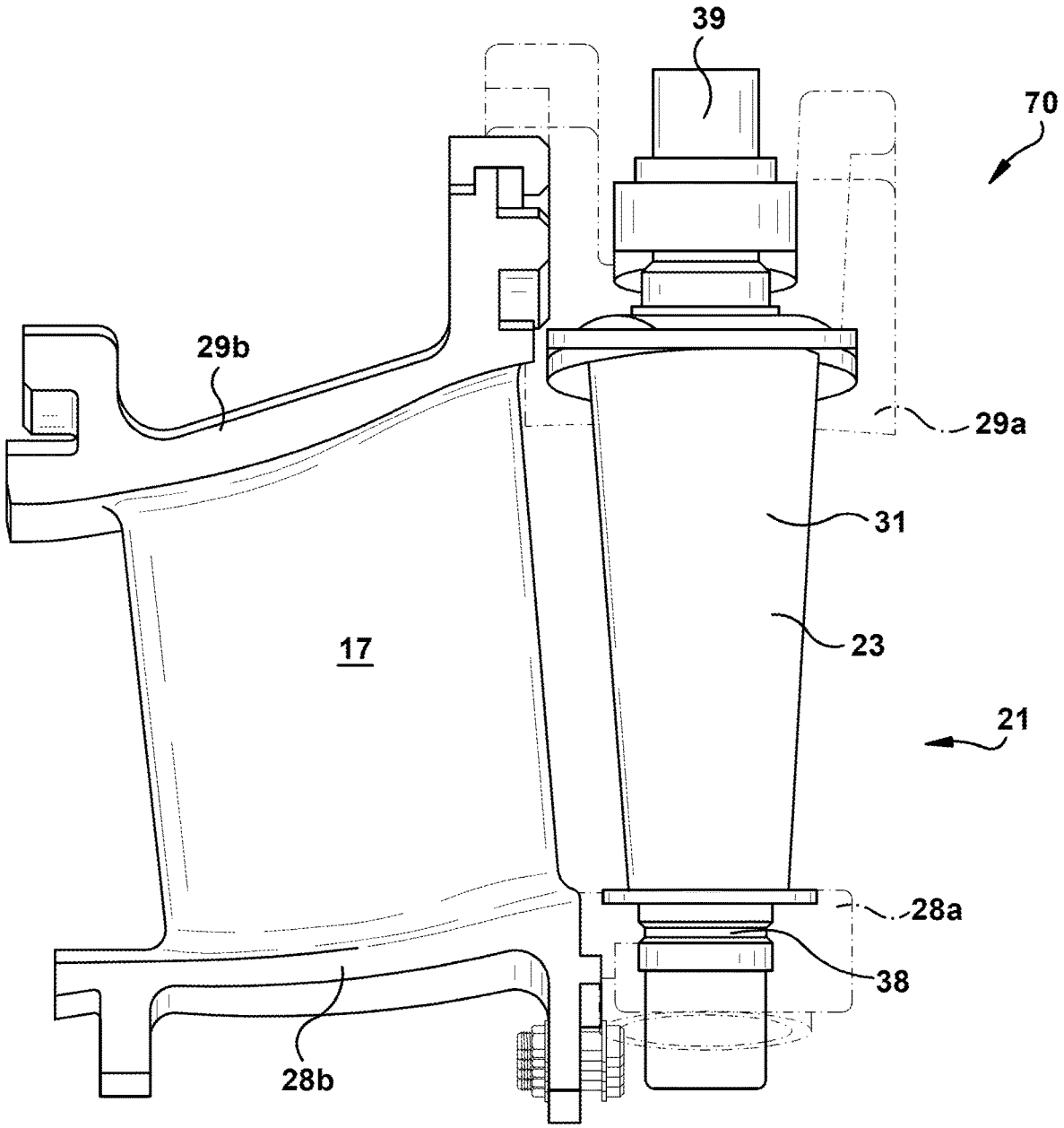
FIG. 8 is a view of a variable nozzle sub-assembly according to exemplary embodiments of the present invention.

Turning now to FIGS. 8 through 18, an exemplary method for constructing a variable nozzle assembly within a turbine engine is presented. As will be seen, the method may include the steps of constructing a variable nozzle sub-assembly, then attaching the variable nozzle sub-assembly to a casing of the turbine engine; and then linking segments of a segmented shaft via a casing opening formed through the casing of the turbine engine. FIG. 8 shows an exemplary variable nozzle sub-assembly 70 that may be constructed in accordance with the exemplary method. In general, the variable nozzle sub-assembly 70 includes a fixed nozzle 17 having an airfoil extending between an upstream inner and outer platforms 29*b*, 28*b*; a first segment 31 of the segmented shaft 30 that includes: an airfoil 23 of the variable nozzle; an inner stem 38 extending from an inner end of the airfoil 23 that includes a spherical shaped section 51; and an outer stem 39 extending from an outer end of the airfoil 23 that includes a spherical shaped section 55; a downstream inner platform 28*a*; and a downstream outer platform 29*a*. According to preferred embodiments, the upstream inner and outer platforms 28*b*, 29*b* may be integrally formed with the airfoil of the fixed nozzle 17. Further, the inner and outer stems 38, 39 may be integrally formed with the airfoil 23 of the variable nozzle 20.

According to exemplary embodiments, the step of assembling the variable nozzle sub-assembly 70 may include several intermediary steps, as will now be discussed with reference FIGS. 9 through 16.

Figure 9:
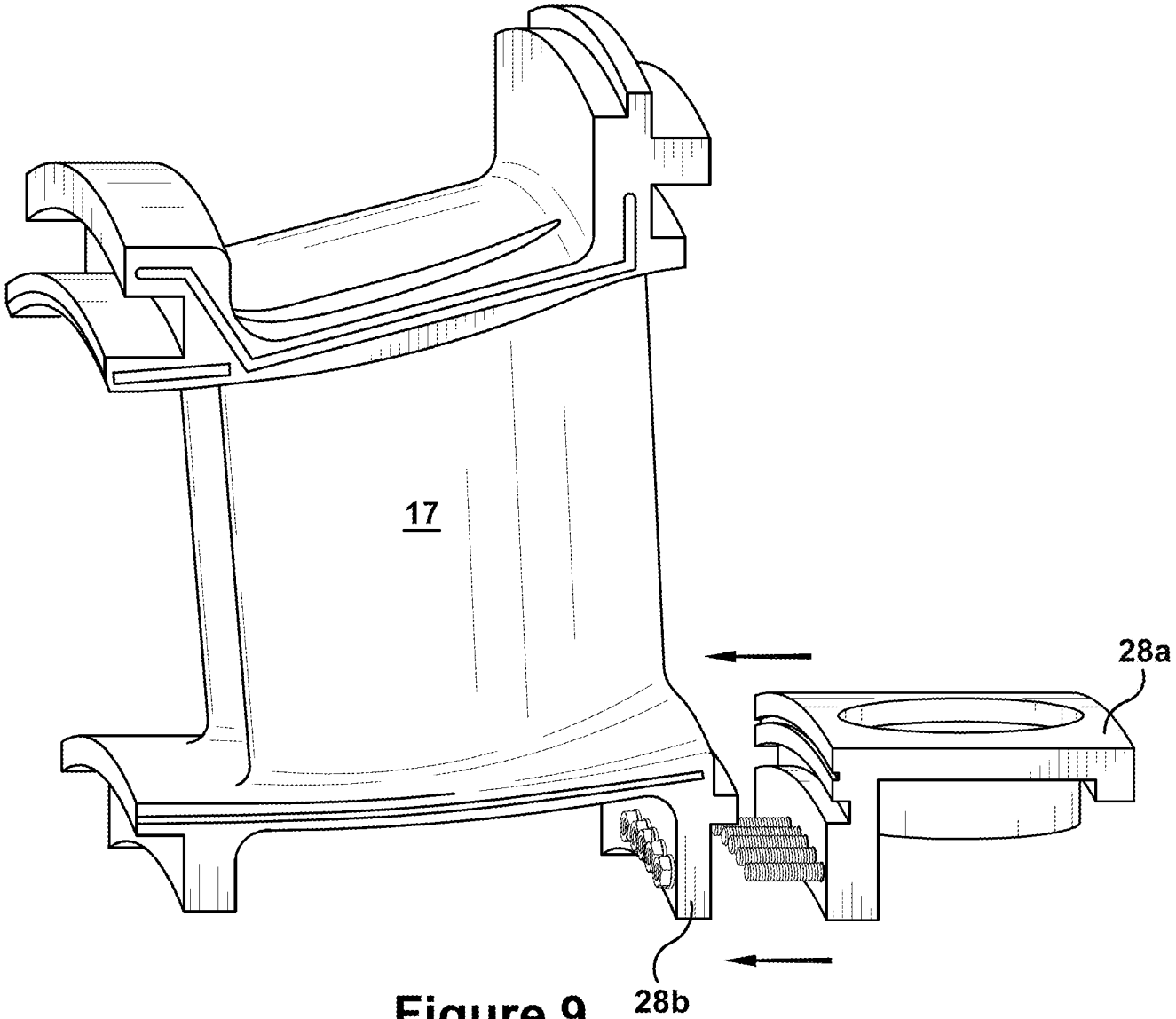
FIG. 9 illustrates an exemplary step as may be included in a method of constructing a variable nozzle in accordance with embodiments of the present invention.

As shown in FIG. 9, an exemplary initial step in constructing the variable nozzle sub-assembly 70 may include attaching the downstream inner platform 28*a* to the upstream inner platform 28*b*. As indicated, this may be done via bolting the aligned sidewalls of the two components. Other types of conventional mechanical fasteners may also be used.

Figure 10:
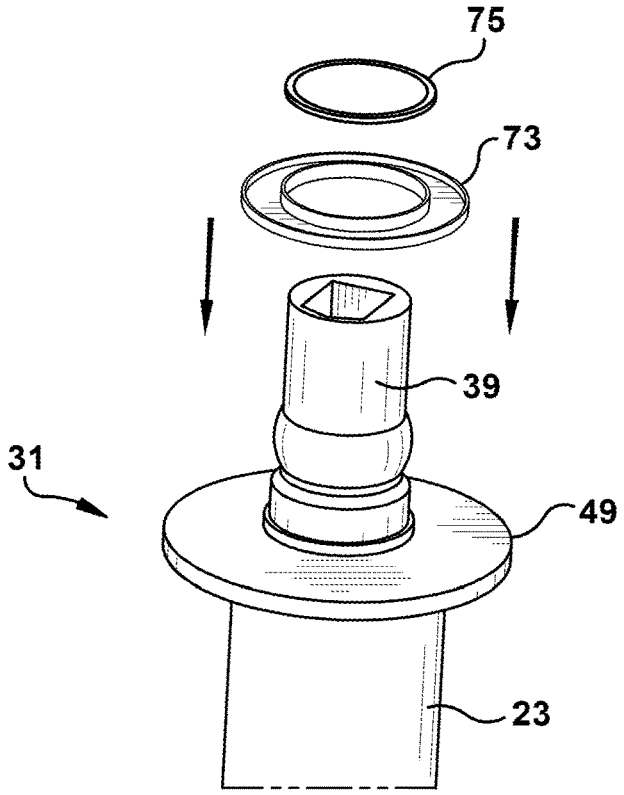
FIG. 10 illustrates an exemplary step as may be included in a method of constructing a variable nozzle in accordance with embodiments of the present invention.
Figure 11:
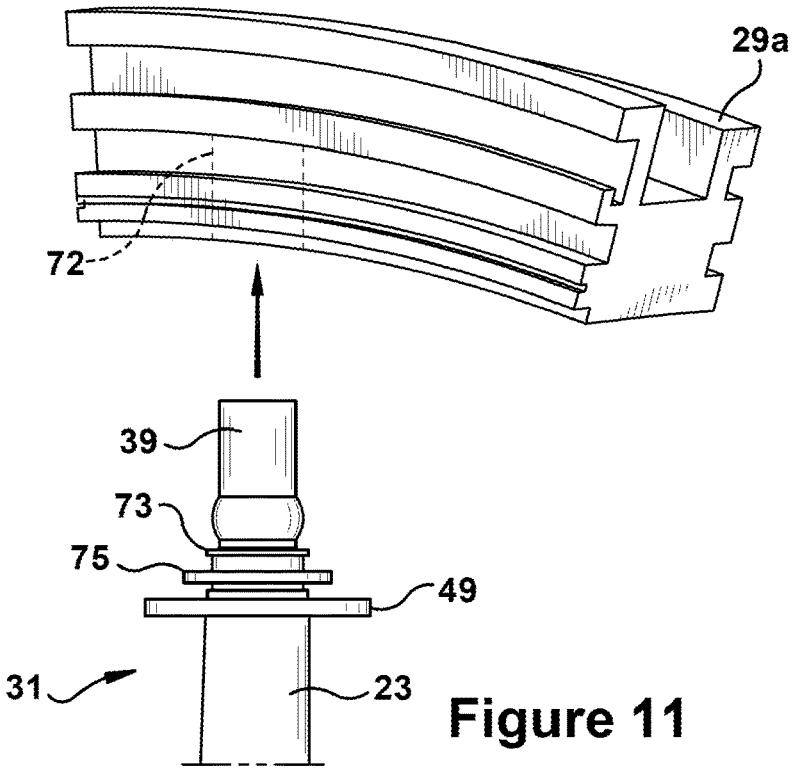
FIG. 11 illustrates an exemplary step as may be included in a method of constructing a variable nozzle in accordance with embodiments of the present invention.
Figure 13:
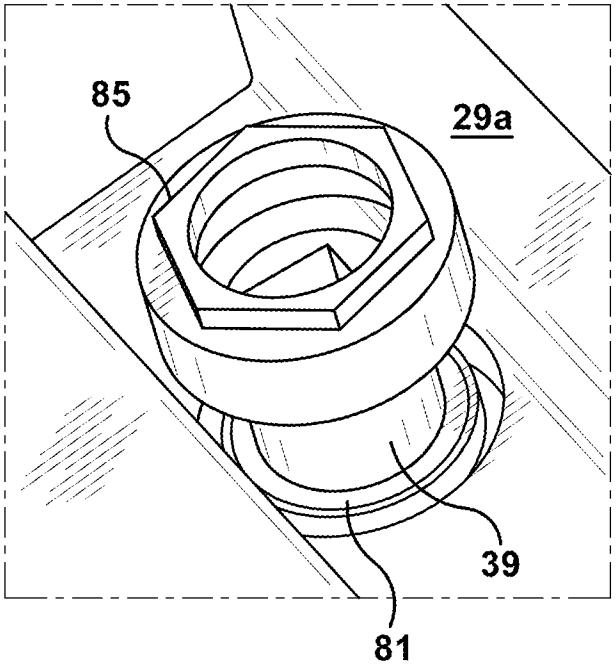
FIG. 13 illustrates an exemplary step as may be included in a method of constructing a variable nozzle in accordance with embodiments of the present invention.
Figure 12:
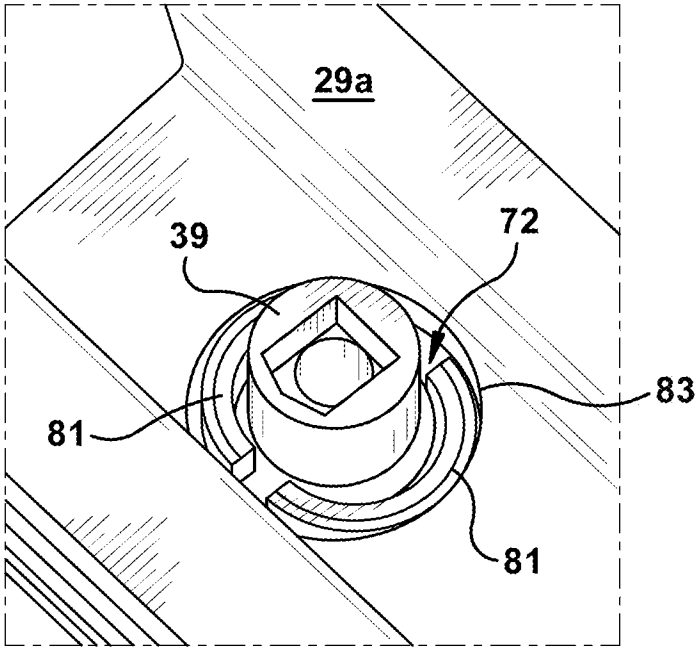
FIG. 12 illustrates an exemplary step as may be included in a method of constructing a variable nozzle in accordance with embodiments of the present invention.

As depicted in FIGS. 10 and 11, a next step in constructing the variable nozzle sub-assembly 70 may include inserting the outer stem 39 through an outer stem opening 72 formed through the downstream outer platform 29*a*, where the insertion of the outer stem 39 results in the spherical shaped section 55 of the outer stem 39 protruding from an outboard side of the downstream outer platform 29*a*. As indicated in FIG. 10, before the outer stem 39 is inserted into the outer stem opening 72, one or more seals may be loaded onto the outer stem 39. As will be appreciated, in this way, the method of the present application facilitates the sealing of the outer boundary of the working fluid flowpath during the construction of the variable nozzle sub-assembly 70. According to preferred embodiments, the one or more seals may include a dish seal 73 and/or a ring seal 75, which are loading by threading each onto the outer stem 39 before the outer stem 39 is inserted into the outer stem opening 72.

As shown in Figured 12 and 13, a next step in constructing the variable nozzle sub-assembly 70 may include connecting the first segment 31 to the downstream outer platform 29*a* by loading a bearing about the protruding spherical shaped section 55 of the outer stem 39. As will be appreciated, this step facilitates assembly of the second connector 42, which was discussed in more detail above. As indicated, the loading of the bearing may include: placing a sectioned cup-ring 81 into a correspondingly shaped recess 83 formed about the circumference the outer stem opening 72 on the outboard side of the downstream outer platform 29*a*; loading a lock-nut 85 onto the outer stem 39; and tightening the lock-nut 85 against the sectioned cup-ring 81 and about the spherical shaped section 55 of the outer stem 39. The sectioned cup-ring 81 may be sectioned into halves, as illustrated. Once the lock-nut 85 is tightened, the abutting sectioned cup-ring 81 and lock-nut 85 may be configured to form a spherical opening 56 (referenced above in relation to FIG. 6) that surrounds the spherical shaped section 55 of the outer stem 39. In this way, a connection (e.g., the above-referenced "second connector 42") may be formed between the downstream outer platform 29*a* and the first segment 31 that prevents relative radial movement between the two components, while allowing relative rotational movement and tilting, as discussed in more detail above.

Figure 14:
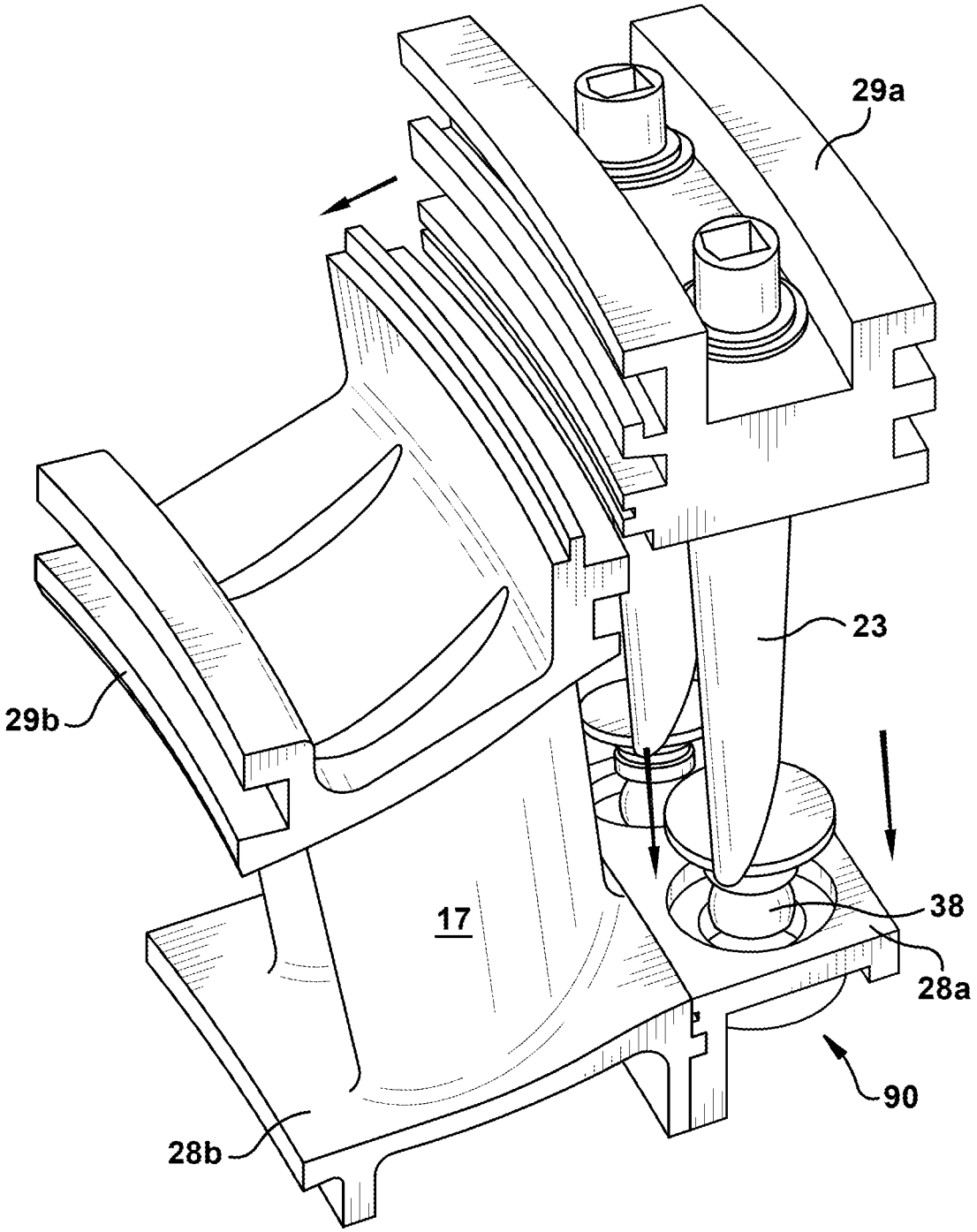
FIG. 14 illustrates an exemplary step as may be included in a method of constructing a variable nozzle in accordance with embodiments of the present invention.

As shown in FIG. 14, a next step in constructing the variable nozzle sub-assembly 70 may include inserting the inner stem 38 through an inner stem opening 90 formed through the downstream inner platform 28*a* while also bringing into alignment a sidewall of the downstream outer platform 29*a* with a sidewall of the upstream outer platform 29*b*. The insertion of the inner stem 38 may result in the spherical shaped section of the inner stem 38 protruding from an inboard side of the downstream inner platform 28*a*. As will be appreciated, the inner stem opening 90 may be over-sized relative to the inner stem 38 so to accommodate enough relative movement between the inner stem 38 and downstream inner platform 28*a* that allows both the insertion and alignment of sidewalls. As will be seen, this "give" between the two components—i.e., the inner stem 38 and downstream inner platform 28*a*—may be removed via the loading of a bearing in this location, as discussed below in relation to FIG. 16.

Figure 15:
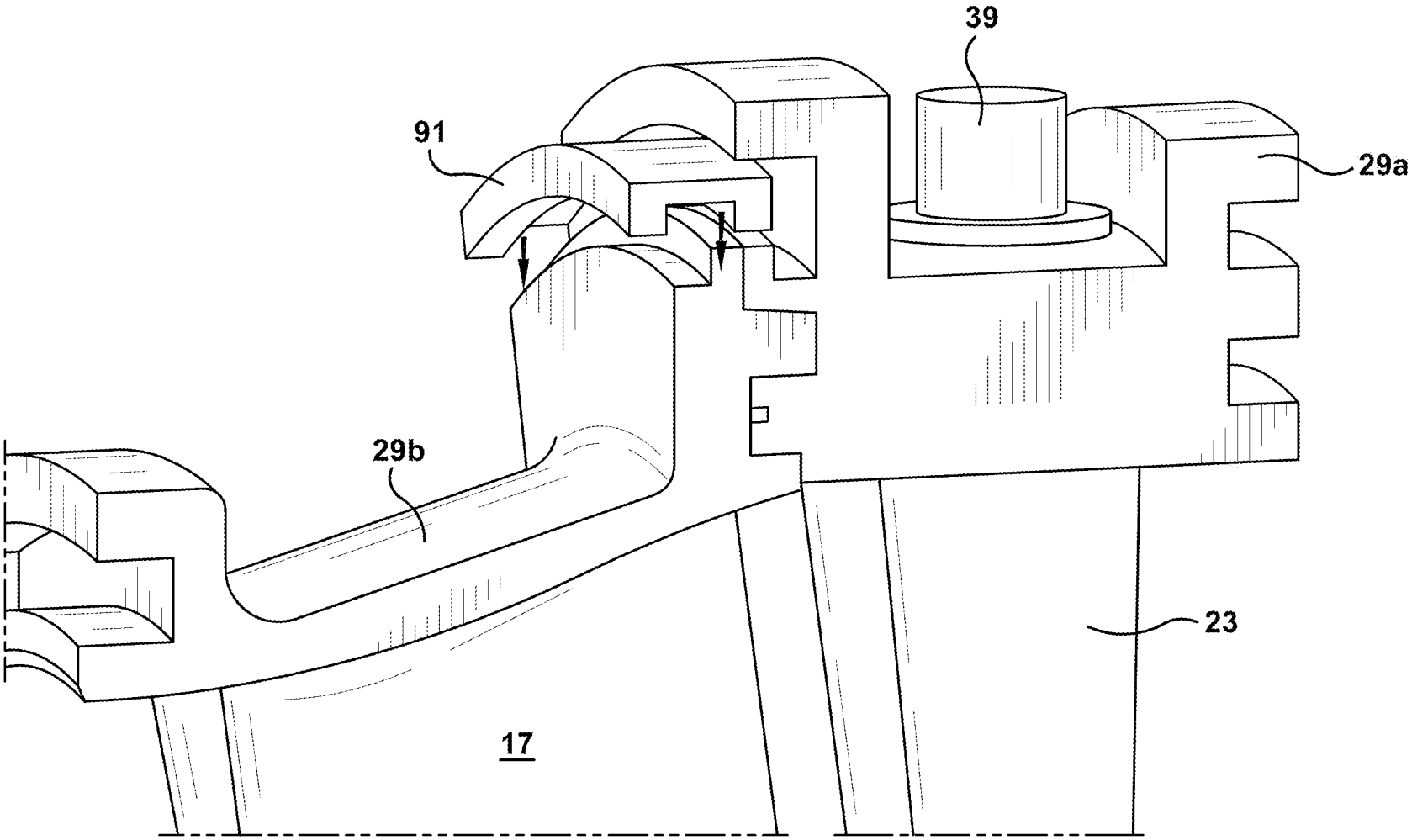
FIG. 15 illustrates an exemplary step as may be included in a method of constructing a variable nozzle in accordance with embodiments of the present invention.

As depicted in FIG. 15, with inner stem 38 inserted within the inner stem opening 90 and the sidewalls properly aligned, a next step in constructing the variable nozzle sub-assembly 70 may include mechanically securing the sidewalls of the downstream outer platform 29*a* and the upstream outer platforms 29*b*. As illustrated, this may include the use of first and second rails configured to correspond to each other, with the first and second rails being disposed on the downstream outer platform 29*a* and upstream outer platform 29*b*, respectively. While the use of other types of mechanical fasteners is also possible, according to preferred embodiments, the mechanically securing of the sidewalls may be efficiently achieved using a C-clip 91. As shown, the C-clip 91 may include an elongated furrow that, upon installation, clamps the first and second rails rigidly against each other, thereby restricting any relative axial movement between the downstream outer platform 29*a* and the upstream outer platform 29*b*.

Figure 16:
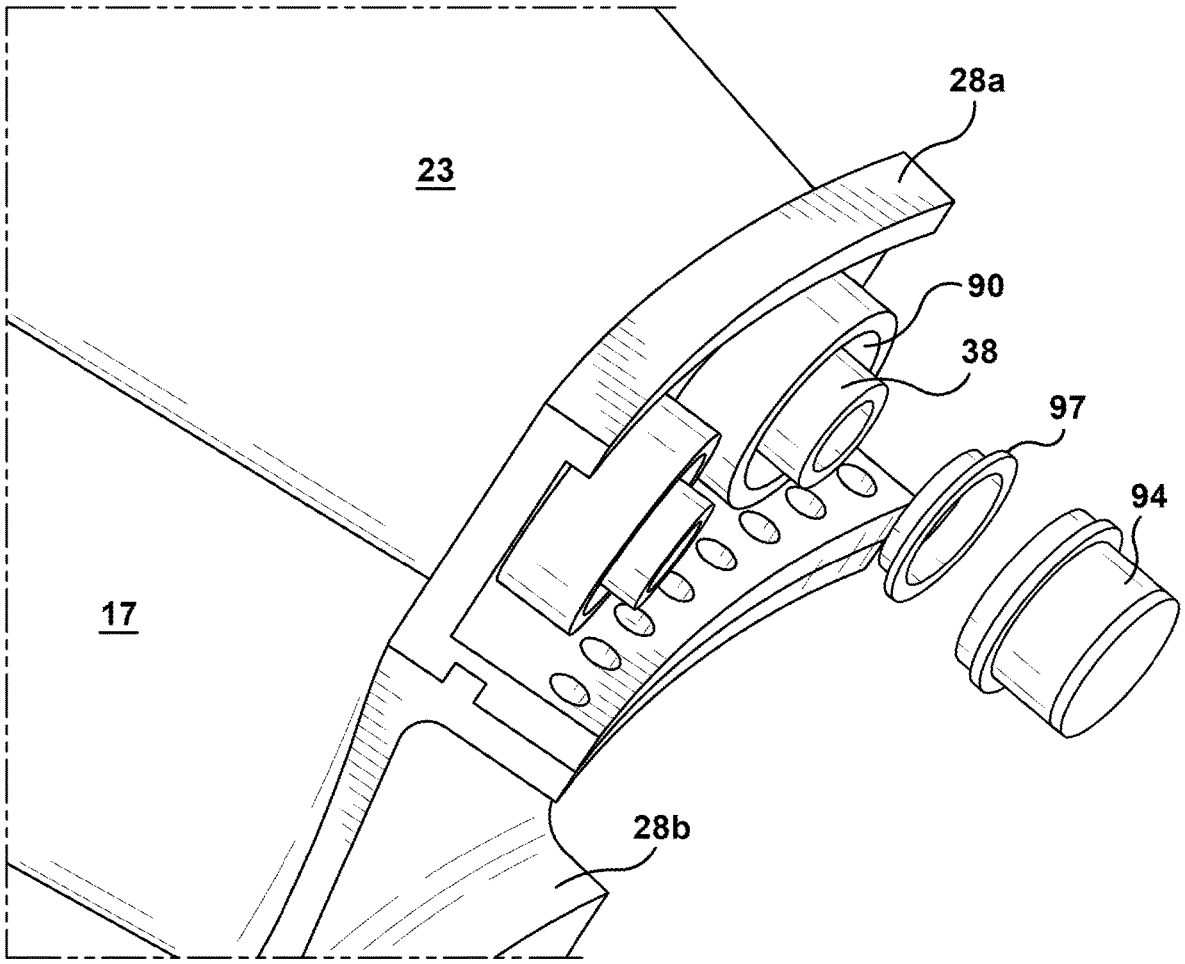
FIG. 16 illustrates an exemplary step as may be included in a method of constructing a variable nozzle in accordance with embodiments of the present invention.

As shown in FIG. 16, a next step in constructing the variable nozzle sub-assembly 70 may include further connecting the first segment 31 to the downstream inner platform 28*a*. As stated above, this may be done by taking away the "give" or clearance existing between the inner stem 38 and the surrounding downstream inner platform 28*a* that forms the inner stem opening 90, which was needed to facilitate the insertion/alignment step of FIG. 14. According to preferred embodiments, the first segment 31 may be further connected to the downstream inner platform 28*a* by loading a bearing about the protruding spherical shaped section 51 of the inner stem 38. As will be appreciated, this step facilitates assembly of the first connector 41, which is discussed in more detail above. As indicated, in this case, the loading of the bearing may include securing a bushing cup 94 to the downstream inner platform 28*a* such that the bushing cup 94: resides within the inner stem opening 90; and surrounds the spherical shaped section 51 of the inner stem 38. In this way, a connection (e.g., the above-referenced "first connector 41") may be formed between the downstream inner platform 28*a* and the first segment 31 that prevents relative axial movement between the two components, while allowing relative radial movement, rotational movement, and tilting, as discussed in more detail above.

As also indicated in FIG. 16, before bushing cup 94 is secured within the inner platform 28*a*, one or more seals may be loaded onto the inner stem 38. As will be appreciated, in this way, the method of the present application facilitates the sealing of the inner boundary of the working fluid flowpath during the construction of the variable nozzle sub-assembly 70. According to preferred embodiments, the one or more seals may include a diaphragm seal 97, which is trapped onto the protruding portion of the inner stem 38 before the bushing cup 94 is secured within the inner platform 28*a*. The securing of the bushing cup 94 against the downstream inner platform 28*a* may hold the diaphragm seal 97 in a desired position.

As will be appreciated, the previous steps associated with FIGS. 9 through 16 facilitate the construction of a variable nozzle sub-assembly. As shown, the variable nozzle sub-assembly includes two fixed nozzles and two variable nozzles, but potential embodiments include configurations including one of each nozzle type or more than two of each nozzle type. As further shown, the variable nozzle sub-assembly may include seals for sealing the working fluid flowpath about the variable nozzle. One of the advantages of the disclosed variable nozzle sub-assembly is that it is a robust assembly that may be shipped for efficient installation within remotely located turbine engines. An example of this efficient installation will now be discussed.

Figure 17:
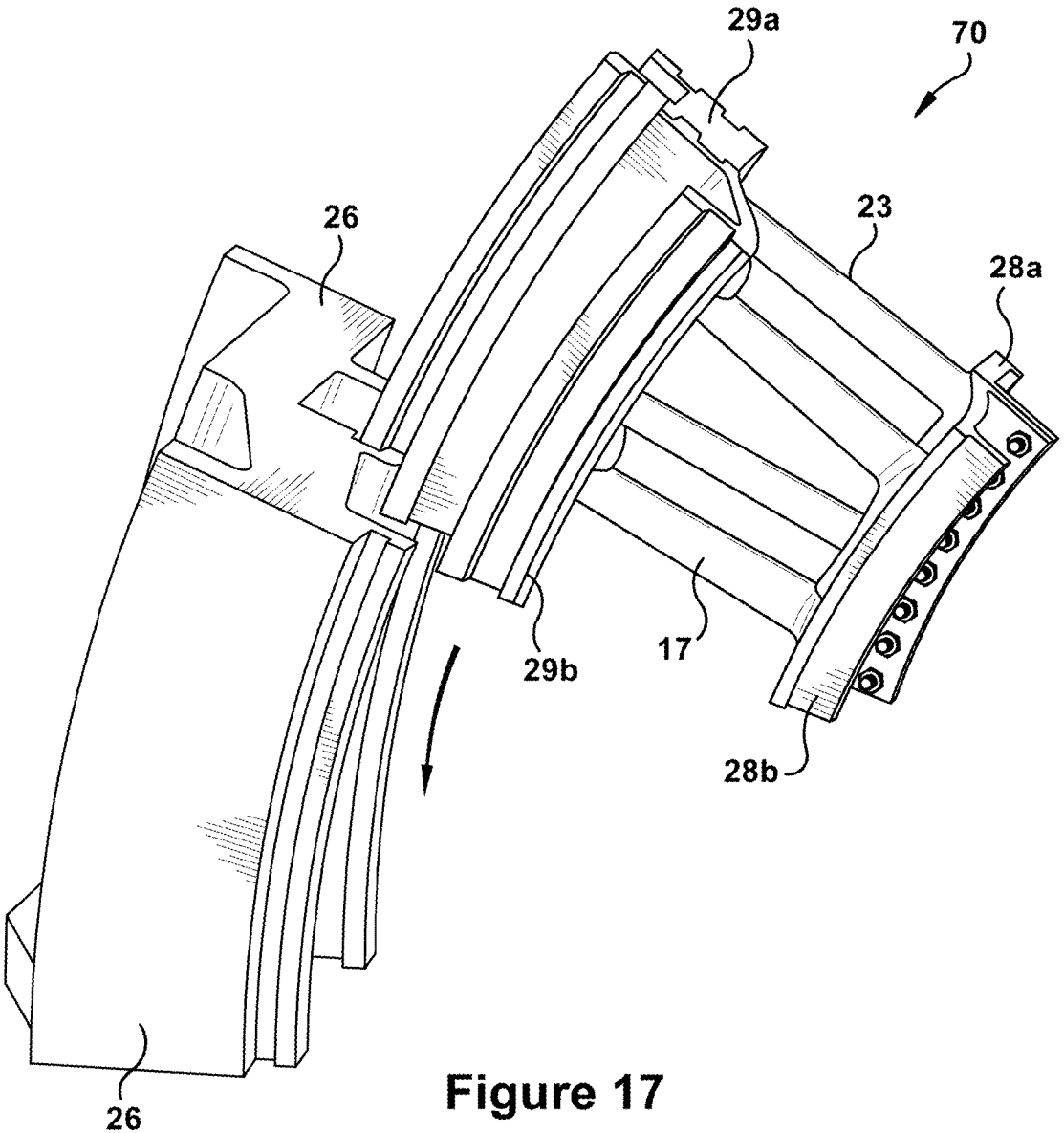
FIG. 17 illustrates an exemplary step as may be included in a method of constructing a variable nozzle in accordance with embodiments of the present invention.
Figure 18:
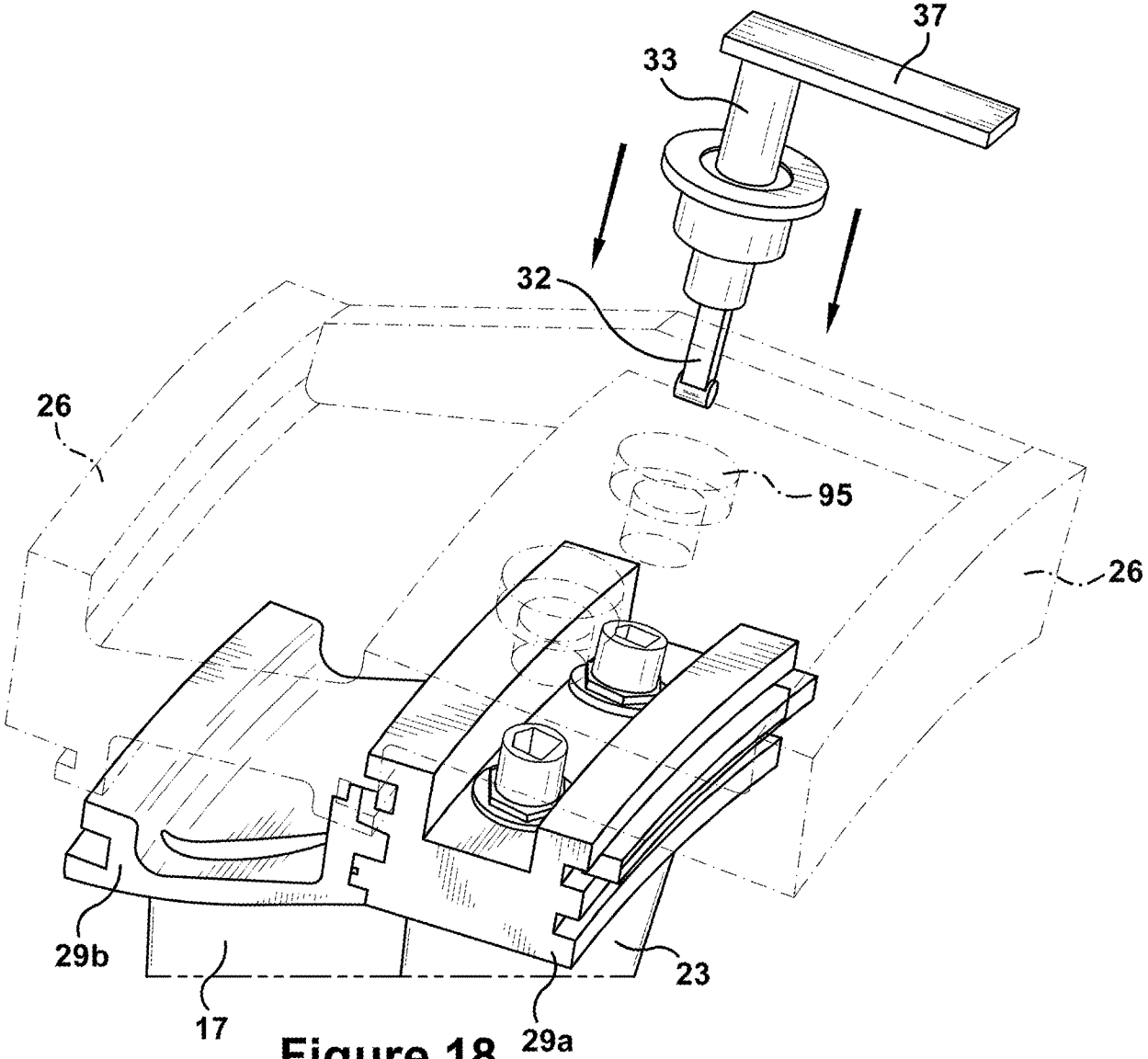
FIG. 18 illustrates an exemplary step as may be included in a method of constructing a variable nozzle in accordance with embodiments of the present invention.

With reference now to FIGS. 17 and 18, the constructed variable nozzle sub-assembly may be installed within a turbine engine, such as, a gas turbine engine. According to preferred embodiments, as depicted in FIG. 17, the step of attaching the variable nozzle sub-assembly 70 to the casing 26 of the turbine engine may include circumferentially engaging a connector in which one or more mating surfaces on the downstream and upstream outer platforms 29*a*, 29*b* interlock with one or more corresponding mating surfaces formed in the casing 26. Other types of connectors may also be used.

As shown in FIG. 18, once engaged within the casing 26, the variable nozzle sub-assembly 70 may be circumferentially aligned according to casing openings 95 (i.e., openings formed through the casing 26). This is done to facilitate the linking of the segments of the segmented shaft 30 though such casing openings 95. According to preferred embodiments, a second segment 32 may be inserted through one of the casing openings 95 for connecting with the first segment 31. This connection—which was discussed in more detail above as the "third connector 43"—may be formed by a first universal joint that connects a first longitudinal end of the second segment 32 and a distal end of the outer stem 39 of the first segment 31. With reference also to FIG. 7, the first universal joint may include an opening 61 that receives a correspondingly shaped insertable portion 62. As discussed above, the opening 61 of the first universal joint may be formed in the distal end of the outer stem 39, while the insertable portion 62 is formed on the first longitudinal end of the second segment 32. The nature of the first universal joint facilitates assembly in that, because the joint is intended to allow relative radial movement between the first and second segments, the connection is conveniently formed upon the insertion of the insertable portion of the second segment 32 within the corresponding opening of the first segment 31.

As already discussed above, the segmented shaft 30 of the variable nozzle assembly 70 may further include a third segment 33. As shown in FIG. 18, in order to facilitate the linking to the first segment 31, the second segment 32 may already be connected to the third segment 33 when the second segment 32 is threaded through the casing opening 95 of the casing 26. The connecting of the second segment 32 to the third segment 33 may have included engaging a second universal joint that connects a second longitudinal end of the second segment 32 to a first longitudinal end of the third segment 33. This connection—which was discussed in more detail above as the "fourth connector 44" in relation to FIG. 7—may include an opening 64 that receives a correspondingly shaped insertable portion 65. The opening 64 of the second universal joint may be formed in the first longitudinal end of the third segment 33, while the insertable portion 65 of the second universal joint may be formed on the second longitudinal end of the second segment 32.

The present method may further include the step of engaging a connection between the third segment 33 and the casing of the turbine engine. This connection—which was discussed in more detail above as the "fifth connector 45" in relation to FIG. 7—may include a cylindrical bearing that allows rotational movement of the third segment 33 relative to the casing 26 of the turbine engine. The present method may further include connecting the segmented shaft 30 to a torque input. For example, as shown in FIG. 18, a second longitudinal end of the third segment 33 may connect to a driver arm 37. As already described, the driver arm 37 may be configured to deliver the torque that is translated through the segmented shaft 30 for rotating the airfoil of the variable nozzle 20.

As one of ordinary skill in the art will appreciate, the many varying features and configurations described above in relation to the several exemplary embodiments may be further selectively applied to form the other possible embodiments of the present invention. For the sake of brevity and taking into account the abilities of one of ordinary skill in the art, each of the possible iterations is not provided or discussed in detail, though all combinations and possible embodiments embraced by the several claims below or otherwise are intended to be part of the instant application. In addition, from the above description of several exemplary embodiments of the invention, those skilled in the art will perceive improvements, changes and modifications. Such improvements, changes and modifications within the skill of the art are also intended to be covered by the appended claims. Further, it should be apparent that the foregoing relates only to the described embodiments of the present application and that numerous changes and modifications may be made herein without departing from the spirit and scope of the application as defined by the following claims and the equivalents thereof.

That which is claimed:

1. A turbine engine having a variable nozzle assembly that comprises:

a variable nozzle having an airfoil that extends radially across an annulus formed between inner and outer platforms, the airfoil comprising inner and outer ends defined at the inner and outer platforms, respectively; and a segmented shaft that translates a torque between segments included therewithin, the segmented shaft including a first and second segment;

wherein the first segment of the segmented shaft comprises:

the airfoil of the variable nozzle;

an outer stem extending from the outer end of the airfoil; and an inner stem extending from the inner end of the airfoil;

wherein:

a first connector and a second connector connect the first segment to the inner platform and outer platform, respectively; and a third connector connects the first segment to the second segment;

wherein:

the first connector and the second connector comprise a first spherical bearing and a second spherical bearing, respectively; and the third connector comprises a first universal joint.

2. The turbine engine according to claim 1, wherein the turbine engine comprises a gas turbine engine and the annulus is formed within a turbine of the gas turbine engine;

wherein rotation of the airfoil between a first operating position and a second operating position modifies a flowpath characteristic through the annulus; and wherein:

one of the spherical bearings of the first and second connectors is configured to allow radial movement of the first segment relative to the corresponding one of the inner and outer platforms; and the other one of the spherical bearings of the first and second connectors is configured to prevent radial movement of the first segment relative to the corresponding other one of the inner and outer platforms.

3. The turbine ending according to claim 1, wherein the first connector is configured such that, upon engagement, the first connector:

allows radial movement of the first segment relative to the inner platform; and allows rotational movement of the first segment relative to the inner platform.

4. The turbine engine according to claim 3, wherein the first connector comprises a spherical shaped section received within a correspondingly sized cylindrical opening; and wherein:

the spherical shaped section of the first connector is formed on a distal end of the inner stem; and the cylindrical opening of the first connector is formed within the inner platform.

5. The turbine engine according to claim 3, wherein the second connector is configured such that, upon engagement, the second connector:

prevents radial movement of the first segment relative to the outer platform; and allows rotational movement of the first segment relative to the outer platform.

6. The turbine engine according to claim 5, wherein the second connector comprises a spherical shaped section surrounded by a correspondingly shaped spherical opening;

wherein:

the spherical shaped section of the second connector is formed on the outer stem; and the spherical opening of the second connector is formed within the outer platform.

7. The turbine engine according to claim 5, wherein:

a proximal end of the inner stem comprises a plate that rotatably engages a correspondingly shaped recess formed on the inner platform; and a proximal end of the outer stem comprises a plate that rotatably engages a correspondingly shaped recess formed on the outer platform.

8. The turbine engine according to claim 2, wherein the third connector is configured such that, upon engagement, the third connector:

allows radial movement of the first segment relative to the second segment; and prevents rotational movement of the first segment relative to the second segment.

9. The turbine engine according to claim 8, wherein the third connector comprises an opening that receives a correspondingly shaped insertable portion; and wherein:

the opening of the third connector is formed in a distal end of the outer stem; and the insertable portion of the third connector is formed on a first longitudinal end of the second segment.

10. The turbine engine according to claim 8, wherein the segmented shaft of the variable nozzle assembly further comprises a third segment;

wherein a fourth connector connects a second longitudinal end of the second segment to a first longitudinal end of the third segment; and wherein the fourth connector comprises a second universal joint.

11. The turbine engine according to claim 10, wherein the fourth connector is configured such that, upon engagement, the fourth connector:

prevents radial movement of the second segment relative to the third segment; and prevents rotational movement of the second segment relative to the third segment.

12. The turbine engine according to claim 11, wherein the fourth connector comprises an opening that receives a correspondingly shaped insertable portion;

wherein:

the opening of the fourth connector is formed in the first longitudinal end of the third segment; and the insertable portion of the fourth connector is formed on the second longitudinal end of the second segment;

wherein:

the first universal joint of the third connector is configured to allow relative movement changing an angle formed between longitudinal axes of the first and second segments while still translating the torque between the first and second segments; and the second universal joint of the fourth connector is configured to allow relative movement changing an angle formed between longitudinal axes of the second and third segments while still translating the torque between the second and third segments.

13. The turbine engine according to claim 11, wherein the outer platform is supported by a casing of the turbine;

wherein:

from the first longitudinal end, the third segment extends through a casing opening formed through the casing of the turbine toward a second longitudinal end of the third segment;

the second longitudinal end of the third segment comprises a connection with a driver arm that delivers the torque translated through the segmented shaft for rotating the airfoil.

14. The turbine engine according to claim 13, wherein a fifth connector connects the third segment to the casing of the turbine; and wherein the fifth connector comprises a cylindrical bearing that allows rotational movement of the third segment relative to the casing of the turbine.

15. A variable nozzle assembly in a turbine of a gas turbine engine, the variable nozzle assembly comprising:

axially stacked nozzles in which a fixed nozzle is positioned upstream of a variable nozzle, each of the fixed and variable nozzles comprising an airfoil that extends radially across an annulus formed between inner and outer platforms; and a segmented shaft that translates a torque between segments included therewithin, the segmented shaft including a first and second segment;

wherein:

the inner platform is axially divided into an upstream inner platform, which connects to the fixed nozzle, and a downstream inner platform, which connects with the variable nozzle; and the outer platform is axially divided into an upstream outer platform, which connects to the fixed nozzle, and a downstream outer platform, which connects with the variable nozzle;

wherein the first segment of the segmented shaft comprises:

the airfoil of the variable nozzle;

an outer stem that extends from an outer end of the airfoil; and an inner stem that extends from an inner end of the airfoil;

wherein:

a first connector and a second connector connect the first segment to the downstream inner platform and downstream outer platform, respectively; and a third connector connects the first segment to the second segment;

wherein:

the first connector and the second connector comprise a first spherical bearing and a second spherical bearing, respectively; and the third connector comprises a first universal joint.

16. The variable nozzle assembly according to claim 15, wherein the upstream inner and outer platforms are integrally formed with the airfoil of the fixed nozzle;

wherein the inner and outer stems are integrally formed with the airfoil of the variable nozzle;

wherein the upstream inner platform connects to the downstream inner platform via a rigid connection formed along abutting sidewalls; and wherein the upstream and downstream outer platforms are supported by a casing of the turbine.

17. The variable nozzle assembly according to claim 16, wherein the first connector is configured such that, upon engagement, the first connector:

allows radial movement of the first segment relative to the downstream inner platform; and allows rotational movement of the first segment relative to the downstream inner platform;

wherein the second connector is configured such that, upon engagement, the second connector:

prevents radial movement of the first segment relative to the downstream outer platform; and allows rotational movement of the first segment relative to the downstream outer platform; wherein the third connector is configured such that, upon engagement, the third connector:

allows radial movement of the first segment relative to the second segment; and prevents rotational movement of the first segment relative to the second segment.

18. The variable nozzle assembly according to claim 17, wherein the segmented shaft of the variable nozzle assembly comprises a third segment;

wherein a fourth connector connects a second longitudinal end of the second segment to a first longitudinal end of the third segment; and wherein the fourth connector comprises a second universal joint that is configured such that, upon engagement, the fourth connector:

prevents radial movement of the second segment relative to the third segment; and prevents rotational movement of the second segment relative to the third segment.

19. The variable nozzle assembly according to claim 18, wherein:

the first universal joint of the third connector is configured to allow relative movement changing an angle formed between longitudinal axes of the first and second segments while still translating the torque between the first and second segments; and the second universal joint of the fourth connector is configured to allow relative movement changing an angle formed between longitudinal axes of the second and third segments while still translating the torque between the second and third segments.

20. The variable nozzle assembly according to claim 18, wherein:

from the first longitudinal end, the third segment extends through a casing opening formed through the casing of the turbine toward a second longitudinal end of the third segment;

the second longitudinal end of the third segment comprises a connection with a driver arm that delivers the torque translated through the segmented shaft for rotating the airfoil;

wherein a fifth connector connects the third segment to the casing of the turbine, the fifth connector comprising a cylindrical bearing that allows rotational movement of the third segment relative to the casing of the turbine.

* * * * *